United States Patent [19]
Anderson
[11] 4,318,290
[45] Mar. 9, 1982

[54] SWAGING MACHINE FOR ELONGATED BODIES OF METAL, E.G. END PIECES FOR WIRES IN BOAT-RIGS

[76] Inventor: Leif G. E. Anderson, Bjurholmsplan 31, S-116 63 Stockholm, Sweden

[21] Appl. No.: 166,902

[22] Filed: Jul. 8, 1980

[51] Int. Cl.[3] ..... B21B 39/04

[52] U.S. Cl. ..... 72/205; 72/198; 72/252; 29/517

[58] Field of Search ..... 140/111, 113; 72/189, 72/191, 192, 194, 197, 198, 205, 212, 213, 252; 29/517, 282, 283.5

[56] References Cited

U.S. PATENT DOCUMENTS

| | | | |
|---|---|---|---|
| 1,845,077 | 2/1932 | Dixon et al. | 29/517 |
| 2,113,228 | 4/1938 | Bassett, Jr. et al. | 140/113 |
| 2,193,450 | 3/1940 | Dixon et al. | 140/113 |
| 2,248,147 | 7/1941 | Wilson | 72/189 |
| 2,439,170 | 4/1948 | Kratoville et al. | 72/252 |
| 2,979,085 | 4/1961 | Rogge | 72/189 |

*Primary Examiner*—Lowell A. Larson
*Attorney, Agent, or Firm*—William E. Mouzavires

[57] ABSTRACT

A swaging machine for tight-swaging of end pieces (42) on a wire (44), cable, metal bar or metal filament having two with rolling grooves provided rolls (34,36) being freely rotatably mounted on two shaft journals secured to a base support. The machine is provided with a pulling device (54,56) that is securable by coupling means to the end piece when this end piece member is put in between the rolls and that can be controlled by an hydraulic driving unit (16) preferably for pulling the end piece between the rolls.

6 Claims, 9 Drawing Figures

SWAGING MACHINE FOR ELONGATED BODIES OF METAL, E.G. END PIECES FOR WIRES IN BOAT-RIGS

The present invention refers to swaging machines with two rolls for swaging of elongated, usually cylindrical bodies, to a smaller gauge.

More in detail, the invention relates to swaging machines for compressing of sleeve-formed bodies of metal, as an end piece intended to be fastened to the end of a wire, cable, metal bar or metal filament. The end piece has a cylindrical barrel extending into the end piece from its one end. At the other end of the end piece there is usually provided a holding means in the form of an eye intended for the attachment to fittings for example on a boat.

There exists, however, a number of other fields where there is a need for a swaging machine of the kind in question, being simple, cheap, easy to handle, and reliable, to roll fixedly, an end piece or a sleeve-formed part on a wire or the like upon the wire having been cut to the required length.

To achieve the radial permanent deformation required of the sleeve-formed part of the wire end piece, after the wire end being inserted into the cylindrical barrel of the end piece, there exist some few types of machines in practical use. One of these machines works by means of hammer strokes, but this way of working has so great disadvantages that it is not used, if one has access to a machine that works with swaging.

Especially when it concerns larger end-pieces and correspondingly large wires or metal bars, the forces will be considerable on the rolls and their bearings.

Swaging machines so far known of the kind in question, are driven either manually by means of a crank device or by means of an electric motor. The driving power is changed in a gear box by means of a number of drive gears, and finally the driving moment is transmitted to a gear wheel rotationally fixedly connected with the one roll, which gear wheel in turn transmits the driving moment to a gear wheel which is rotationally fixedly connected with the other roll.

The two rolls consist of circular discs or wheels each of them provided with a roll groove. These grooves form together the form to which the sleeve-formed part shall be deformed during the swaging moment, seen in cross-section.

The swaging procedure is usually performed in two steps, in that the sleeve-formed part is oriented in a first pivoted position relatively the rolls and thereafter in a further following swaging operation with the sleeve-formed part in a position pivoted 90°.

With the known swaging machine thus the driving of the rolls is performed by the transmission of comparatively great torques via a number of gear wheels, usually a comparatively small pinion and a comparatively large gear wheel. Owing to the great forces that in this case are transmitted between the gear wheels it often happens that one of the gear wheels breaks, so that several machines must be available as stand-by machines. That a gear wheel breaks happens in most cases when the swaging machine is motor-driven with a more or less overdimensioned electric motor, which does not respond to the resistance against the swaging operation being unusually high on occasions. By manual driving instead, it is possible for an operator to feel when the resistance starts to be too heavy for the machine, but as motion by motor is less fatiguing, motor driven machines are used in most cases when the machine shall be used in one and the same place, i.e. for stationary use.

Owing to the fact that the forces developed are great, the parts of the machine must in corresponding degree, be generously proportioned. This leads to the fact that the machines hitherto known will be comparatively large, heavy and troublesome to handle and to transport. Should they be dimensioned for maximum security against breaks and to maintain the predestinated play between the rolls during the swaging operation, the known machines should be still larger, heavier and difficult in handling.

Another drawback with the known machines is that the wire end pieces usually are bent more or less during the swaging operation, as that part of the end piece being rolled and located after the swaging pinch, is free and unloaded, so that it can be bent by the strains generated in connection with the comparatively heavy deformation during the swaging operation. After the swaging operation, the end pieces usually are straightened in an hydraulic press, which thus will imply an additional and time-consuming moment of work.

A further drawback with the known swaging machine is that it is intended to be driven in one swaging direction only. If it concerns a wire or a metal bar of comparatively great length, firstly an end piece must be tightly rolled on the one end of the wire, and thereafter the whole wire or the metal bar must be turned in order to be able to place the other end in the machine. This inconvenience can be very troublesome, if it concerns wire lengths rating for example 20 m and more, and in such cases when the work takes place in confined locations.

A swaging operation is per se preferable to a hammer operation, and therefore the object of the present invention is to provide a swaging machine which, to a great extent, eliminates the inconveniences with the known swaging machines.

This is achieved by means of a swaging machine which, according to the invention, has the features indicated in the appended claims.

Within the frame of the invention, the pulling device can be driven manually by an electric motor or hydraulically. However, the hydraulic alternative is preferable in most cases. If the swaging machine according to the invention is stationary, it is easy and cheap to use an electrically driven hydraulic pump. If, on the other hand, the swaging machine shall be as small and easy as possible, to be used as a transportable auxilliary means for swaging operations, an hydraulic pump driven by means of a foot pedal can be used, or it can be controlled by a manual lever.

By choosing pressure oil as working fluid the pulling device will be simple and cheap, as it only will be a question of choice of the desired size of an hydraulic cylinder of standard performance. To achieve the pulling movement either the hydraulic cylinder can be movable, while the rod piston and plunger in that case are fixed in the base of the machine, or the hydraulic cylinder can be fixed in the base while the rod piston and the plunger are movable. On the movable part in either case a connecting device is applied which easily can be coupled to the eye of the wire end piece, when the end piece with the wire end inserted therein, has been placed in position between the rolls for starting of the swaging operation. The rolls are in known manner provided with a recess in the rim, and when these recesses are positioned opposite each other, the end piece can be put down in the free space that is offered by the recesses between the rolls. The connection between the end piece or other sleeve-formed metal part with the pulling device can be provided in different ways that affords quick interlinkage and release, respectively. When it is the question of an eye bolt or the like, the pulling device can, for example, be provided with a hook or a pin that is hooked into the eye of the end piece element.

As the rolls and the gear wheels connected thereto are freely rotatable, the rolls can easily be adjusted manually into the desired position. After positioning of the wire end piece between the opened rolls, these are turned on until they bite against the end piece. Thereafter the pulling device is interlinked for pulling operation resulting in a movement of the end piece parallel to the pulling direction, up to an increased friction bite with the rolls. The diameter of the rolls and the shape of their roll grooves are here chosen in such a way that the pulling of the endpiece results in a bite of the rolls and thereby forces them to rotate, their rotation is here synchronized by their uniform bite in with the wire end piece.

Upon the first swaging operation having been accomplished, the rolls are set by hand in an open position, and the end piece together with its wire is pulled back and turned 90° for the performance of a second and final swaging operation.

The forces obtained with the machine according to the invention are mainly those which are generated between the rolls during the swaging operation, i.e. the forces taken up perpendicular to the stationary shaft journals of the rolls. It is thus a question of choosing shafts journals rigid and large enough, and mount them at a heavy base plate. Any risk of overloading of the gear wheels does not exist, as these only have the purpose of synchronizing the rolls at the engagement of the rolls against the wire end piece for the start of the swaging operation, i.e. any drive does not take place via the gear wheels as previously mentioned. The position of the rolls radially relatively each other, i.e. the play between the rolls, is thus maintained during the swaging operation, as their bearing can be made stable enough without any difficulty.

From the above, it is obvious that the synchronized gear wheels can have a comparatively small axial thickness, as they hardly transmit any forces. The shaft journals mounted in the base plate can thus by that means be made short and with large dimensions for the mounting of the rolls in a comparatively short distance from the support point of the shafts journals in the base plate. The bending moment on the shaft journals will in corresponding degree be essentially smaller than at the known machines, as the moment arm will be shorter. At the known machines, the shaft journals are in fact mounted in two axially separated bearings and have power transmission pinions and gear wheels having comparatively great axial thickness, to be able to carry the comparatively great driving moments being present.

The pulling device is mounted on the support or frame of the machine and this pulling device can be chosen stable enough to be able of carrying the forces developed by the pulling device in question, which usually is an hydraulic cylinder and piston arrangement.

If the swaging machine shall be used for very long wires or metal bars it is easy to extend the swaging machine to comprise a double-acting machine that can roll in both directions. In this case, two pulling devices are arranged one after the other, one on each side of the pair of rolls, and are directed for pulling in opposite directions. By this simple means with the swaging machine according to the invention, it is not necessary to turn around a long wire, cable or metal bar when this is to be provided with end-pieces at both ends. First the one end piece is tightly secured by swaging at one end of the wire by utilizing the one pulling device and thereafter the wire is pulled forward in a straight path until the other end of the wire with its end piece is situated between the rolls, where the swaging operation of this end piece is performed with the other pulling device.

These and other characterizing features and advantages of the invention will be explained further with reference to the accompanying drawings, showing two suitable embodiments of the swaging machine according to the invention.

Figure 1:
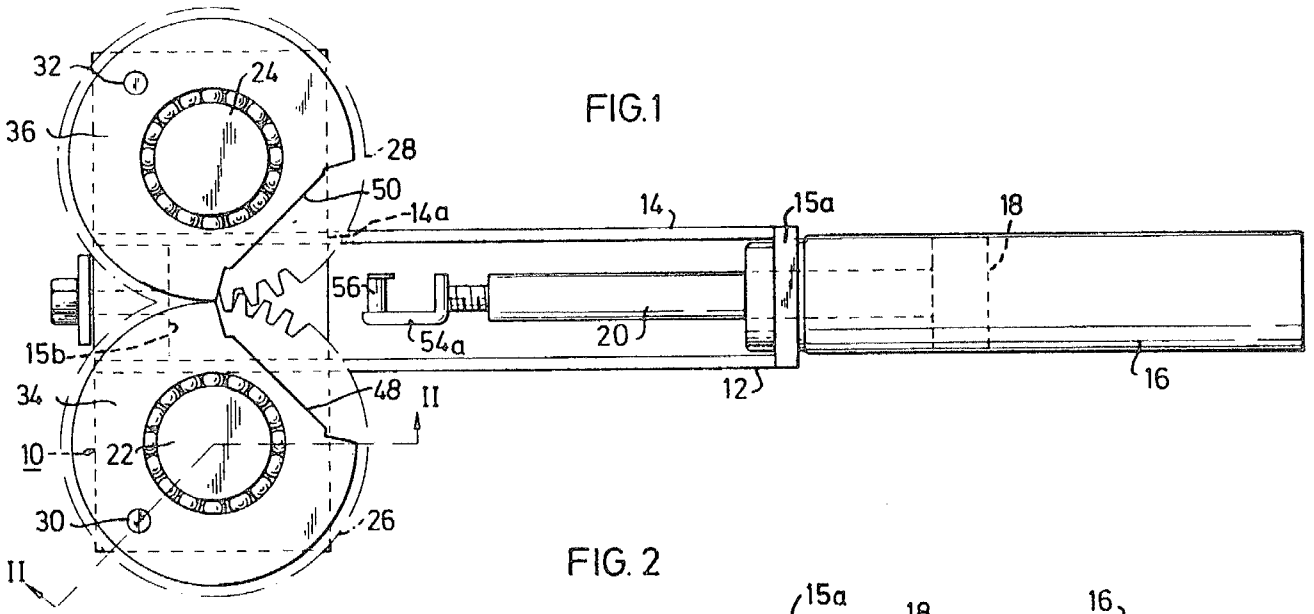
FIG. 1 is a top view of a simple and portable swaging machine according to the invention.
Figure 2:
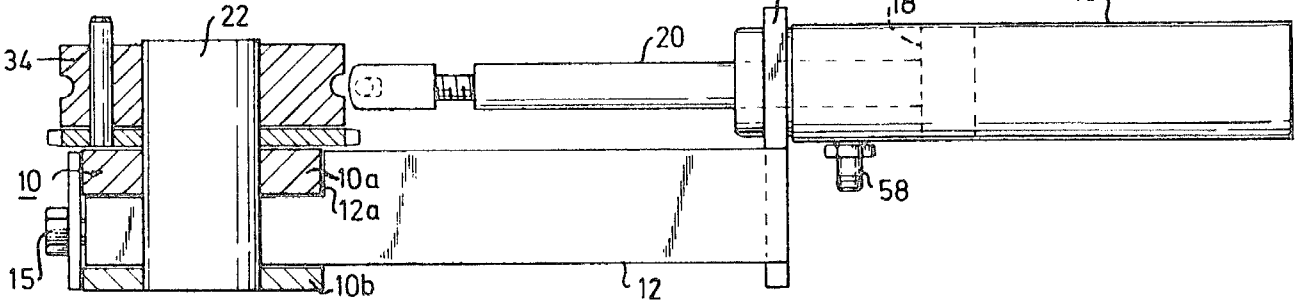
FIG. 2 is a sectional view of the machine in FIG. 1 with a section according to the line II—II in FIG. 1.
Figure 3:
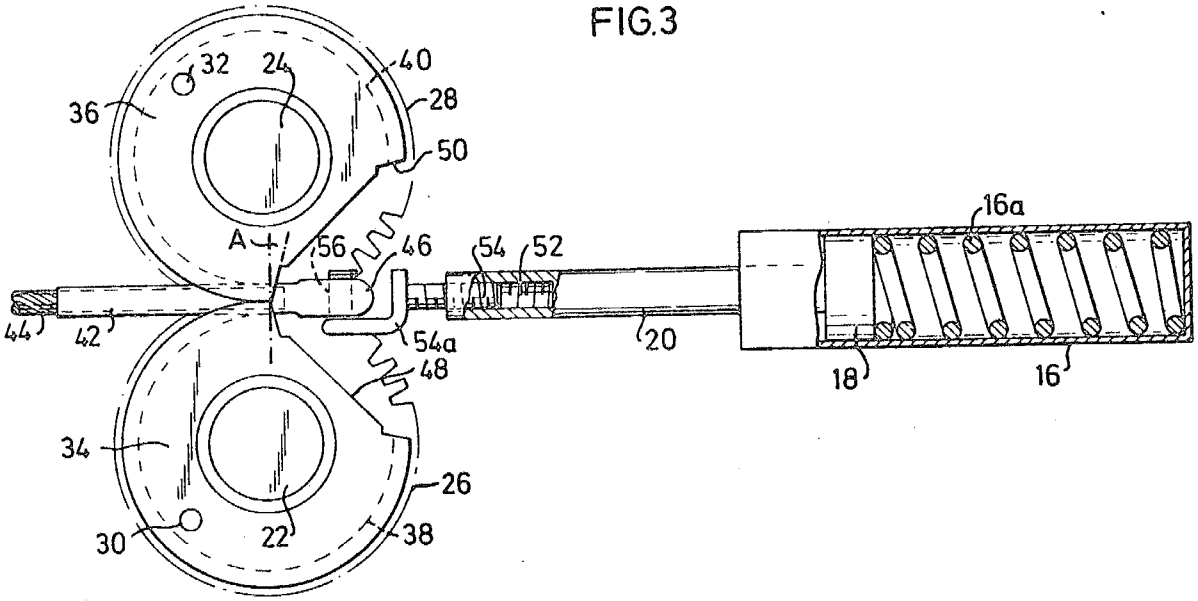
FIG. 3 is a schematic view of the machine in FIG. 1 with certain details broken and a wire piece end placed between the rolls for swaging.

The machine shown in FIGS. 1–3 has a base plate consisting of a cross member 10 in the form of two plates 10*a*,10*b*. Between these the one end of a pair of arms 12,14, are inserted, which arms at their ends are secured to end plates 15*a*, 15*b*. The end plate 15*b* has a threaded hole for a fixing screw 15*c*, the head of which abuts a supporting plate 15*d*, which in turn abuts the plates 10*a*, 10*b*, when the screw is tightened to secure the recesses 12*a*, 14*a* of the arms 12,14 to the plate 10*a*. By this detachable mounting of the arms 12,14 to the plates 10*a*,10*b*, it is easy to exchange the arms 12,14 at need against another pair of arms with other length desired.

In the end plate 15*a* between the outer ends of the arms 12,14 is detachably secured the one end of an hydraulic cylinder 16 with a spring-actuated piston 18, the rod piston 20 of which lies at right angles against the plates 10*a*,10*b*.

In the plates 10*a*,10*b* two shaft journals 22,24 are mounted, each of which supporting a corresponding freely rotatable gear wheel 26,28. The gear wheels are not intended to transmit any mentionable force, so they can have the very small axial thickness shown on the drawing. If desired, the gear wheels can be made of plastic, as they shall not be exposed to loads.

In each gear wheel an axial locating pin 30,32 is fixed.

The gear wheels 26,28 have been mounted so that they mesh with each other in a position of the locating pins 30,32, where these are symmetrically oriented relative a line through the centres of the shaft journals 22,24.

On the shaft journals 22,24 is also a pair of rolls 34,36 freely rotatably mounted by means of roller bearings, which rolls each has its own axial clearance hole for receipt of the locating pin 30,32, respectively. The mutual position of the rolls is thus determined by the locating pins 30,32 and the gear wheels 26,28.

The rolls have the shape of wheels with a cylindrical circumference, in which is cut up an essentially half-cylindrical groove 38,40 respectively, in a known manner. These grooves form together the bite between the rolls that shall roll a cylindrical wire end piece 42 with a wire 44 inserted therein (FIG. 3).

As is obvious from the figures, the plate 10*a* is essentially thicker than the plate 10*b* and forms hereby a stable base plate for the shaft journals 20,22. The distance between the rolls and the plate 10*a* will be short, as the gear wheels 26,28 are comparatively axially thin.

The end piece 42 consists of a sleeve-formed cylindrical part that at the one end is shaped with an eye 46 in known manner. In the cylindrical bore of the end piece, the one end of the wire 44 is inserted. By rolling of the sleeve-formed part of the end piece this part will be exposed to a permanent deformation and clamp tightly the inserted wire in a known way.

Figure 4:
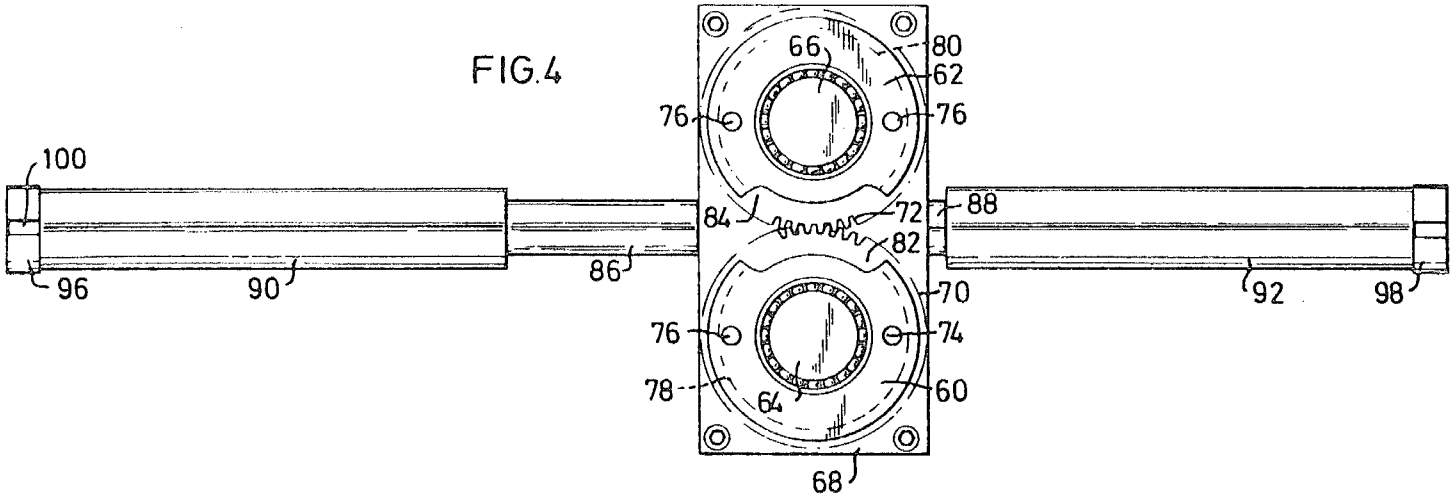
FIG. 4 is a top view of another embodiment having two pulling devices enabling swaging operations in both directions.

In the circumference of the rolls is cut a recess 48,50, respectively, so that when the recesses stand opposite each other, the rolls are set in an inactive or open position, in which the end piece 42 can be laid in, respectively be taken out. This position is schematically shown in connection with the other embodiment in FIGS. 4 and 6. The locating pins 30,32 are positioned diametrically opposite the recesses 48,50. Besides, the pins have such a length that they have the upper end freely protruding above the rolls so that it is possible to grasp one or the other pin by hand and turn the rolls up to the position desired, when the rolls are not in swaging engagement with the end piece.

At the end of the rod piston 20 a threaded shaft 54 is screwed into a threaded hole 52, and the shaft 54 being fixed to a bracket member 54*a* provided with a coupling stud 56, which is intended to be detachably coupled to the eye 46 of the end piece according to FIG. 3 .

In FIG. 3 the rod piston is shown in its outer end position, from which it can, by supply of pressure oil through the inlet 58 (FIG. 2) to the cylinder 16, be pulled in by the piston 18 to an inner end position.

The magnitude of the pulling force can hereby, in a simple manner, be chosen by the size of a standard version of an hydraulic cylinder and the pressure of the pressure oil.

The inlet 58 can be connected to a pressure oil source in the form of, for example, a pedal driven or a hand driven oil pump (not shown). When the piston reaches its inner end position, the supply of pressure oil to the cylinder is interrupted in a known manner to prevent overload. A return spring 16*a* brings the piston back to the starting position.

The swaging operation is carried out in the following manner. The end piece 42 with wire 44 inserted and enclosed therein is placed between the rolls 34,36 in their open position. The eye 46 of the end piece is hooked on the stud 56. If the position of the end piece needs to be corrected, this can be easily done by screwing the shaft 54 in one direction or other in the rod piston 20.

Thereafter the rolls are turned by hand to the starting position shown in FIG. 3, where the grooves 38,40 with their end edges are brought to fit against the end piece exactly at the position, which has been determined by means of the position of the shaft 54, threaded into the piston rod 20, when this is situated in its outer end position. The aim of this position is that the rolls shall start the swaging operation nearly where the end piece ceases to be hollow and changes into a solid end piece with the eye 46.

As is obvious from FIG. 3 the ends of the recesses at the grooves are chamfered at an angle A that preferably is about 15°. The bottoms of the grooves 38, 40 will hereby bite into the end-piece 42 some time before the lateral edges of the grooves will come to engagement with the end piece 42 in that very moment, when the end edges of the grooves are biting the end piece according to FIG. 3. This has in practice proved to be more suitable than to have the ends of the recesses radially cut, which results in an instantaneous fit up of the end edges of the whole groove instead of the gradual fit up achieved with the chamfering according to FIG. 3. Especially at the terminating second swaging operation of the wire end piece, a more exact bite is achieved with chamfered ends and by that a greater safety that the gear wheels remain unloaded.

In the next step, pressure oil is let through to the cylinder 16 so that it starts pulling forward the wire end piece between the rolls 34,36. Owing to the bite between the rolls and the friction obtained thereby between the freely rotatable rolls and the end piece, the rolls will be driven around by the end piece, when this is pulled in the direction towards the cylinder. By this is thus achieved the desired swaging of the end piece. After ended swaging, the rolls are set in an open position by turning by hand and the end piece is returned to the starting position and is turned around 90°, after which a further swaging operation is carried out. By being exposed all time to a considerable pulling force, the end piece will in its finished swagged state be straight and does not need to be subject to truing after the swaging operation as often is the case as known swaging machines.

The base support is simple in its design and can be made stable without being bulky and cumbersome. The shaft journals 22,24 can be chosen sufficiently heavy and be fixedly mounted, so that they will maintain the exact position of the rolls relative each other during the swaging operation. Forces appearing during the swaging operation are taken up by the base support, so this need not be clamped, but can be used lying freely.

The different working moments are simple and rapid, so the swaging of an end piece can be carried out without special technical knowledge by practically anybody in a comfortable and safe manner.

The rolls are easily exchangeable for differently dimensions of end pieces. For the exchange of gear wheels and/or rolls it is only necessary to pull them off the shaft journals 22,24.

Finally, the machine can, owing to its simple design, be manufactured at a much lower price in relation to known machines. If a comparatively long wire shall be provided with end pieces in both ends, firstly the one end can be rolled and thereafter pull ahead the wire so that its other end will be placed at the swaging machine. The swaging machine can then easily be turned by hand for the swaging of the other end of the wire, as the machine is not heavier than that a single man easily can lift, carry and turn the machine, when this is dimensioned for the most common wire diameters that exist.

At the machine, according to the invention, it would be conceivable to omit the gear wheels 26,28, and instead carry out the setting up of the rolls in such a way that they are brought by hand to engagement, both of them, with the end piece, whereupon the pulling and swaging operation will start. During the swaging operation the rolls are synchronized by the pulling moment forwards of the end piece. However, it is considerably more rapid and safe to use the gear wheels 26,28, as facilitating means for an exact setting up of the rolls for the engagement of the end piece.

In the swaging machine according to FIGS. 4–9 the same pair of rolls 60,62 are mainly used as the rolls 34,36 in FIG. 1. The rolls 60,62 are thus freely rotatably mounted, by means of roll bearings, on heavy and short shaft journals 64,66, which are fixed in a stable base support 68. A pair of synchronized gear wheels 70,72 are freely rotatably mounted on the shaft journals 64,66 and are coupled to the rolls by means of locating pins 74,76 that with their upper ends are situated freely above the rolls to form a handle for the hand, so that the rolls can be turned manually to the desired position. Besides, the rolls have each swaging grooves 78,80 and recesses 82,84, respectively.

The machine, in this case, has two pulling devices, one for swaging in each pulling direction. The pulling devices are identical and have a piston rod 86,88 respectively fixed to the base support 68. The piston rods 86,88 are in alignment with each other located one on each side of the base support 68.

Each piston rod supports the hydraulic cylinders 90,92 respectively, and these cylinders are connected through a connecting shaft 94, so that they are displaced simultaneously on the piston rods in either direction.

Figure 6:
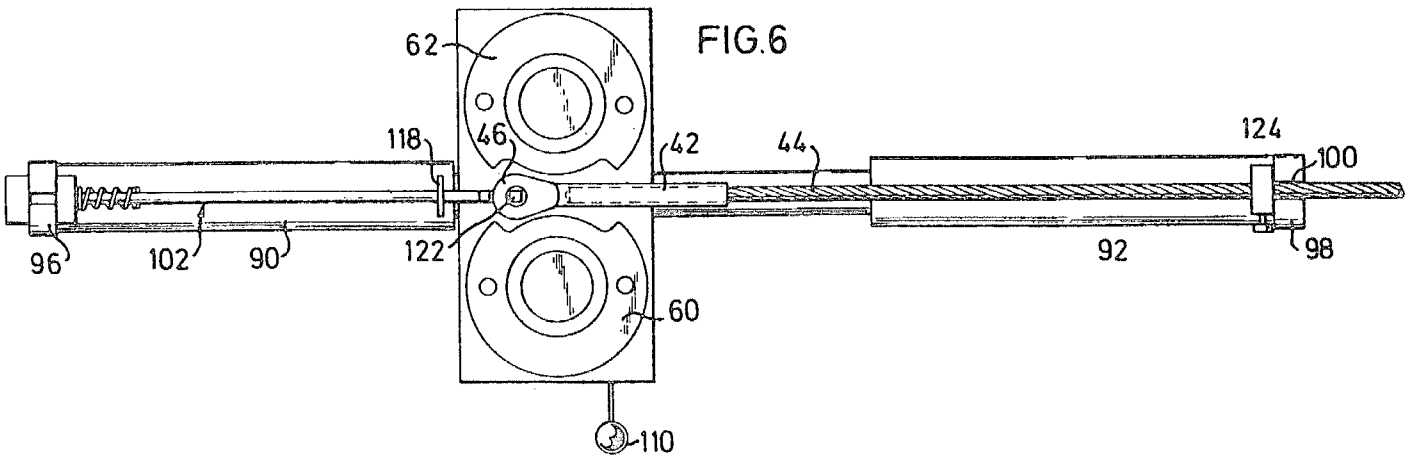
FIG. 6 is a schematic view of the machine with a wire end piece and a wire inserted therein, and the end piece is here shown placed between the opened rolls, and the end piece is linked to the pulling device.
Figure 9:
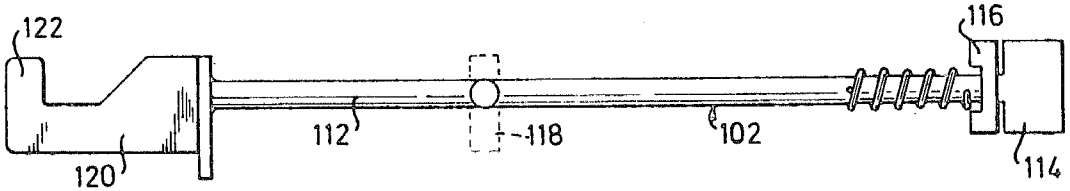
FIG. 9 shows the pulling hook utilized at the machine in FIGS. 6–8.

The cylinders each have the end plates 96,98 respectively with a recess 100 for the attachment of a coupling 102 for the pulling operation according to FIGS. 6 and 9.

Figure 5:
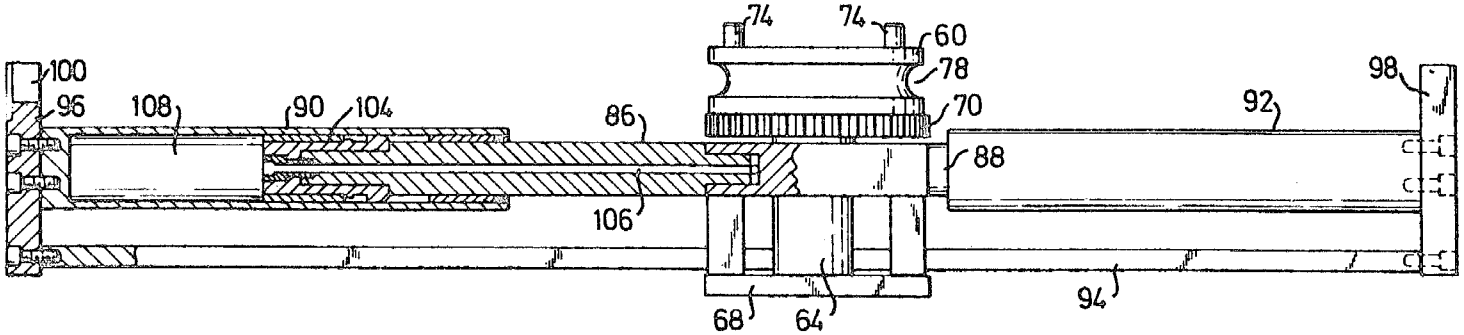
FIG. 5 is a sectional view of the machine in FIG. 4 with certain details broken.

As shown in FIG. 5 for the broken cylinder 90, the piston rod 86 at its end is made as a piston 104. The piston rod 86 has an oil channel 106 for the supply of pressure oil via three-way valve (not shown) to the working room 108 of the cylinder 90, so that the cylinder and consequently also the end plate and the hook 102 (FIG. 6) coupled thereon are displaced in the direction away from the rolls 60,62 with a required pulling force.

The piston rod 88 has a channel corresponding to the channel 106 and a piston within the cylinder 92 so that pressure oil can be supplied by shifting of the valve mentioned in a known way. The valve is switched over by means of a lever 110 that can be set up in an intermediate position, and two outer end positions according to FIG. 8. While the one cylinder is filled with oil, the other cylinder will simultaneously be discharged. In the intermediate position of the lever 110, the machine is standing still.

The hook 102 (FIG. 9) comprises a shaft 112 having at its one end an end piece 114 and a spring-loaded clamping plate 116. By retracting the clamping plate 116, the end part of the shaft 112 can be put down into the recess 100 in the end plate 96, 98 respectively, whereupon the clamping plate locks up the shaft by clamping against the end plate 96,98 respectively.

On the shaft 112 there is a support 118 that is intended to rest on the cylinder 90,92 respectively, so that the shaft 102 is in parallel to each cylinder, respectively.

At the other end of the shaft a hook 120 is secured, the shank 122 of which is intended to be coupled to the eyelet 46 on the end piece 42 that is to be rolled tight to the wire 44 located therein.

This machine primarily is intended for wires and metal bars with larger dimensions and lengths, and consequently it will be larger and heavier than the machine of FIG. 1. However, it is simpler, has a lower weight and is easier to handle than swaging machines known so far.

For swaging of an end piece in the direction showed in FIGS. 6–9, the work is carried out in the following way. The rolls 60,62 are turned by hand up to the open position shown in FIG. 6. The hook 102 is secured in the end plate 96 of the cylinder 90. The end piece 42 with the wire 44 inserted is hooked with its eyelet 46 on the shank 122 of the hook 120, resulting in a correct starting position of the endpiece relative the rolls 60,62, when the cylinder 90 is in its outer end position.

The wire 44 is put into the recess 100 of the end piece 98. A clamping plate 124 is fixed on the wire 44 adjacent to the end-piece 98, so that the pulling forward of the wire during the swaging operation takes place by means of the end plate 98 and thus not influencing the end part of the wire being inserted into the end piece 42.

Figure 7:
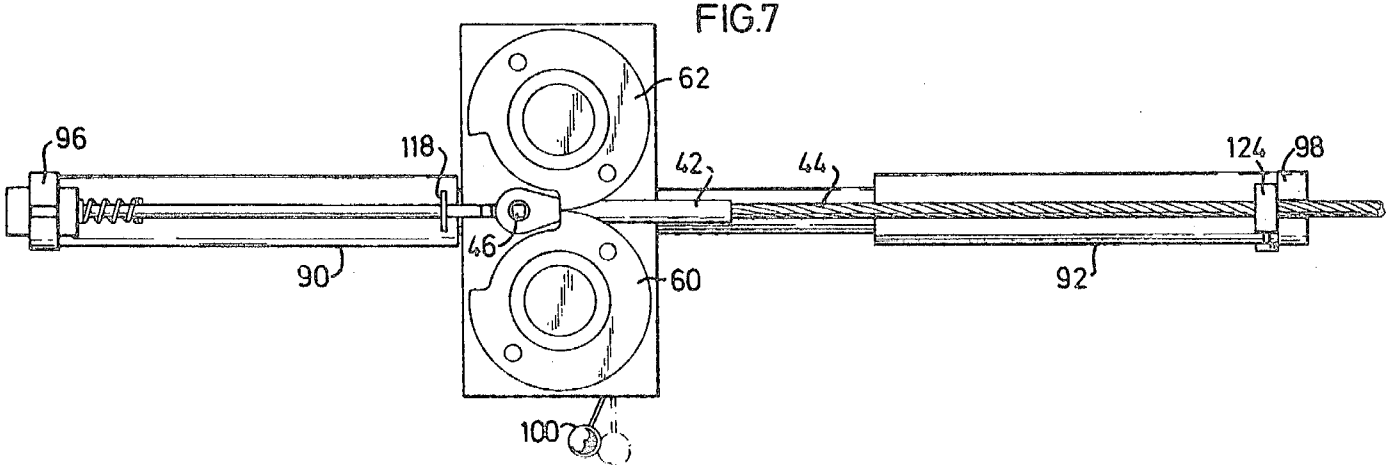
FIG. 7 shows the machine in FIG. 6 with the rolls turned forward to engagement with the end piece.
Figure 8:
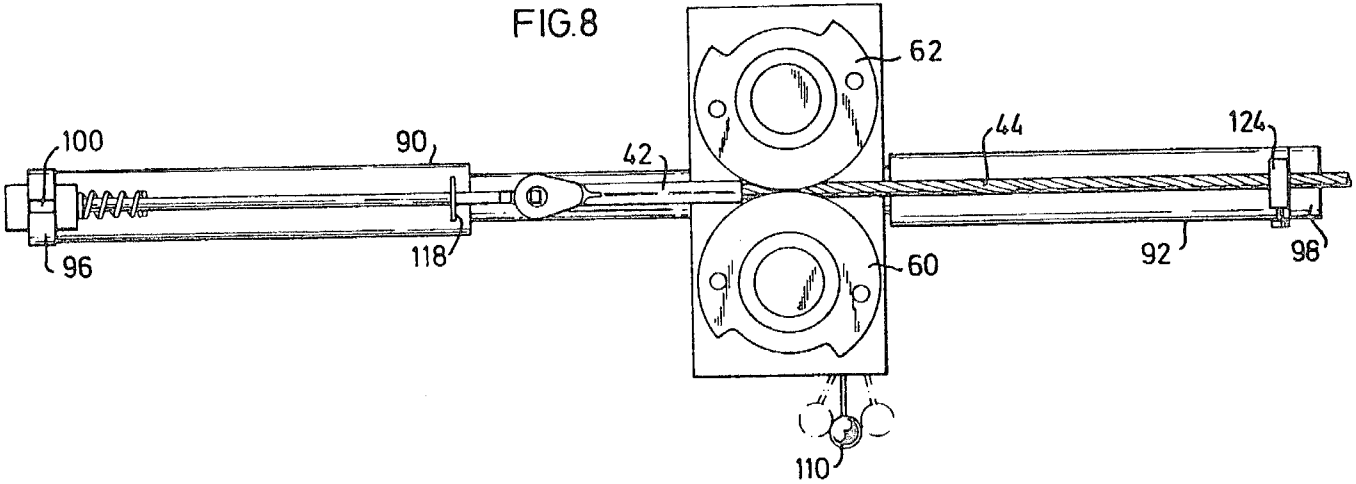
FIG. 8 shows the end piece in position after the pulling through and swaging operation has taken place between the rolls.

In the next step the rolls are turned up to engagement with the end-piece 42 according to FIG. 7, and the gear wheels 70,72 are here utilized to provide the synchronization desired of the rolls, so that they simultaneously bite against the end piece.

Pressure oil is thereafter supplied to the cylinder 90, which results in a pulling movement of the cylinder and that the mentioned cylinder pulls the end piece 42 up between the rolls in swaging and driving them by friction between the rolls and the end piece. Simultaneously pulling force is transmitted from the cylinder 90 via the connecting shaft 94 to the end-plate 98, in order that the wire 44 shall be pulled forward during the swaging without actuating the end piece 42. This is particularly important, if it concerns long and thin wires.

After ended swaging operation the rolls are turned by hand to an open position according to FIG. 6 and the endpiece is pulled back to the starting position between the open rolls and are turned 90°. A further swaging operation is then carried out and ended according to FIG. 8.

If the wire is long and its other end also is to be provided with an end piece, the wire is pulled forward, so that its other end with the end piece will be situated between the rolls. These are now engaged by turning in opposite direction. The lever 110 is now switched over for supply of pressure oil to the cylinder 92, and the swaging operation takes place in the opposite direction.

The machines described above according to the invention, are made for the swaging of metal bodies externally essentially cylindrical sleeve-formed ones. However, the machine can also be used for tight swaging of a metal bar with elliptical or other shaped cross-section in a sleeve-formed metal bar. In this case, the swaging grooves of the rolls are formed for swaging of such a sleeve-formed part, e.g. with elliptical cross-section.

I claim:

1. Swaging machine for elongated bodies of metal with a longitudinal bore for receipt of an inner member, e.g. end pieces, for wires, cables, metal bars or metal filaments, comprising a base support carrying two parallel shaft journals for rotatable bearing of a pair of rolls each provided with rolling grooves in the circumference and a recess in the circumference enabling the insertion of the metal body or the end piece between the rolls, when the two recesses are situated straight opposite each other, characterized in that the machine is provided with a pulling device (54,56; 102) that is detachably securable at one end of the metal bar or the end-piece (42), when this is inserted between the rolls (34,36; 60,62) in their open position (FIG. 6), and that the pulling device is maneuverable by means of a hand-operated, hydraulic (16,90,92), mechanical or electrical driving device for the pulling operation of the metal body or the end piece between the rolls in compression of the metal body or the end piece member and the tight clamping of that member around the inner member inserted therein as a wire (44), cable, metal bar or metal filament.

2. Machine according to claim 1, characterized in that the ends of the rolling grooves (38,40) at the recesses are chamfered and are situated in a plane forming an angle (a) at a radial plane through the end of the groove, so that at the touch of the rolls against the end piece (42) only the end edge of the bottom section of the grooves (38,40) respectively will engage and bite the end piece, whereupon the pulling forward of the end piece results in the fact that the end edges of the sides of the groove first during this forward pulling operation will engage and bite the end-piece.

3. Machine according to claim 1 or 2, characterized in that two with each other interacting gear-wheels (26,28; 70,72) are freely rotatably mounted on the shaft journals (22,24, 64,66), which gear-wheels are coupled (30,32; 74,76) to rolls (34,36; 60,62), respectively mounted on the shafts mentioned to synchronize the turning of the rolls at engagement of these rolls against the end piece (42).

4. Machine according to claim 1, characterized in that the base support consists of a cross plate (10) to which the shaft journals (22,24) are secured and of a longitudinal arm (12,14) arranged at right angle to the cross-plate mentioned carrying an hydraulic cylinder (16) with a piston (18) and a piston rod (20) to form the driving device of the pulling unit (56), and further that the longitudinal arm is detachably (15*b*, 15*c*) secured to the cross-plate.

5. Machine according to claim 1 or 2, characterized in that a piston rod (86,88) with piston (104) and cylinder (90,92) with pulling device (96,98) is arranged on each side of the pair of rolls, in such a way that the piston rods are aligned with each other and are secured to the base support (68), and that the cylinders (90,92) are connected by a connecting rod (94) or the like and controlled by a valve such that when the one cylinder is supplied with pressure oil for the execution of the pulling operation the other cylinder is connected for discharge of oil.

6. Machine according to claim 5, characterized in that the two cylinders are provided with coupling means so that the end of the end-piece (42) is connectable (102) with the one cylinder (90, FIG. 6) at the same time as the wire (44) or the like is connectable (124) with the other cylinder (92).

* * * * *